US009414684B2

(12) United States Patent
Park et al.

(10) Patent No.: US 9,414,684 B2
(45) Date of Patent: Aug. 16, 2016

(54) TILTING TYPE CHAIR

(71) Applicant: Sidiz, Inc., Pyeongtaek-si, Gyeonggi-do (KR)

(72) Inventors: Jong Pyo Park, Seoul (KR); Young Soo Shim, Seoul (KR); Dae Jin Baik, Seoul (KR)

(73) Assignee: SIDIZ, INC., Pyeongtaek-si, Gyeonggi-do (KR)

( * ) Notice: Subject to any disclaimer, the term of this patent is extended or adjusted under 35 U.S.C. 154(b) by 46 days.

(21) Appl. No.: 14/506,719

(22) Filed: Oct. 6, 2014

(65) Prior Publication Data

US 2015/0102648 A1 Apr. 16, 2015

(30) Foreign Application Priority Data

Oct. 10, 2013 (KR) ..... 10-2013-0120455

(51) Int. Cl.
*A47C 7/54* (2006.01)
*A47C 1/032* (2006.01)

(52) U.S. Cl.
CPC ..... *A47C 7/54* (2013.01); *A47C 1/03255* (2013.01); *A47C 1/03277* (2013.01)

(58) Field of Classification Search
USPC ..... 297/340, 344.25
See application file for complete search history.

(56) References Cited

U.S. PATENT DOCUMENTS 7,794,017 B2 * 9/2010 Kan ..... A47C 1/03255 297/284.4
8,899,681 B2 * 12/2014 Ko ..... A47C 1/03261 297/302.3
2012/0313414 A1 * 12/2012 Donati ..... A47C 1/03255 297/340
2013/0221719 A1 * 8/2013 Costaglia ..... A47C 1/03294 297/340
2013/0320732 A1 * 12/2013 Bock ..... A47C 1/032 297/340
2014/0077551 A1 * 3/2014 Battey ..... A47C 1/032 297/300.1
2015/0272328 A1 * 10/2015 Huang ..... A47C 1/03222 297/340

FOREIGN PATENT DOCUMENTS

JP 2010-125061 A 6/2010
JP 2011-92392 A 5/2011
KR 10-2003-0059582 A 7/2003

OTHER PUBLICATIONS

Aug. 25, 2015, Japanese Office Action for related JP application No. 2014-206519.

* cited by examiner

*Primary Examiner* — Timothy J Brindley
(74) *Attorney, Agent, or Firm* — Paratus Law Group, PLLC

(57) ABSTRACT

Disclosed is a tilting type chair. The chair includes: a seat on which a user is seated; a back support configured to support a back portion of the user seated on the seat; and a tilting section interposed between the back support and the seat to couple the seat to the back support. When the user applies a load to bend the back support backward, the tilting section moves the seat upward in proportion to the load applied by the user, and when the load applied to the back support by the user is removed, the tilting section moves the seat downward in proportion to the removed load. As a result, a more comfortable seating feeling may be provided to the user seated on the seat of the chair. In addition, the tilting may be limited as needed by the user. Thus, the chair may further improve the user's convenience.

13 Claims, 11 Drawing Sheets

TILTING TYPE CHAIR

CROSS REFERENCE TO PRIOR APPLICATIONS

The present application claims priority under 35 U.S.C. §119 to Korean Patent Application No. 10-2013-0120455 (filed on Oct. 10, 2013), which is hereby incorporated by reference in its entirety.

BACKGROUND OF THE INVENTION

1. Field of the Invention

The present invention relates to a tilting type chair, and more particularly, to a tilting type chair in which a seat of the chair is movable up and down depending on a direction of a load or movement applied to a back support of the chair by a user and tilting is capable of being limited as needed.

2. Description of the Prior Art

Conventionally, comfort is considered to be one of the most important factors in a chair because a user should be able to be seated thereon for a long time. However, because a place in which such a chair is used may be changed due to, for example, frequent removal, portability and lightweight are recently preferred. Thus, simple chairs are in the spotlight of consumers. However, apart from excellence in portability and lightweight, such a simple chair such has a problem in that it is poor in comfort as compared to a large chair. Whereas, in large chairs, a seat, a back rest and/or arm rests have been provided with a soft cushion for the user's comfort, and the seat and the back rest are configured to be capable of rotating integrally in a state where the legs of the chair are fixed, and thus, the large chairs have been remarkably improved in comfortability.

Many large chairs are provided with a tilting function such that, when a user bends his/her upper body backwards on a large chair, the back rest of the chair is bent backwards in a state where the center of gravity of the chair is maintained, and when the external force applied by the user is removed again, the back rest is returned to its original position.

However, in order to ensure that the tilting function can be executed in a large chair, a means for providing a restoring force, such as a coil spring, is essential for the chair, and the configuration thereof is very complicated. Thus, it is not easy for a person to assemble the chair when the person is not skilled in assembly.

When the tilting means applied to a large chair as described above is applied to a simple chair, a complicated configuration is applied to the simple chair. As a result, the versatility of the simple chair is degraded and the weight of the simple chair is increased, which makes it difficult to adopt the tilting means in the simple chair. Even if the tilting means is applied to the simple chair in such a manner as to suppress an increase of the weight of the simple chair, the tilting function cannot be properly performed because it is not easy to maintain the center of gravity. Further, when the chair is tilted, a seating feeling on the seat is degraded so that the user may feel uncomfortable.

Meanwhile, Korean Laid-Open Patent Publication No. 2003-0059582 discloses a tilting type chair applied to a simple chair, which has been made so as to solve a problem that a user's entire upper body cannot be supported uniformly since a space is produced between a back rest and the user's lumbar vertebrae when the back rest is tilted. For this purpose, the chair disclosed in Korean Laid-Open Patent Publication No. 2003-0059582 is designed such that when the user bends his/her back backwards to tilt the back rest frame, the back rest frame can be deformed to fully support the lumbar vertebrae. However, the chair disclosed in Korean Laid-Open Patent Publication No. 2003-0059582 has a problem in that a separate complicated link structure should be provided in order to allow the back rest frame to be deformed.

PRIOR ART DOCUMENT

Patent Document

Korean Laid-Open Patent Publication No. 2003-0059582 (published on Jul. 10, 2003)

SUMMARY OF THE INVENTION

The present invention has been made in order to solve the above-described problems in the art, and an object of the present invention is to provide a tilting type chair in which a seat of the chair is movable up and down depending on a direction of a load or movement applied to a back support of the chair by a user so as to improve the user's comfortability.

According to an exemplary embodiment of the present invention, there is provided a tilting type chair including: a seat on which a user is seated; a back support configured to support a back portion of the user seated on the seat; and a tilting section interposed between the back support and the seat to couple the seat to the back support. When the user applies a load to bend the back support backward, the tilting section moves the seat upward in proportion to the load applied by the user, and, when the load applied to the back support by the user is removed, the tilting section moves the seat downward in proportion to the removed load.

In addition, the tilting section may include: a tilting body disposed between the back support and the seat; a pair of first connecting blocks configured to connect both sides of a rear end of the tilting body and both sides of a lower end of the back support as well as to connect both sides of a middle lower portion of the seat and both sides of the lower end of the back support; and a pair of second connecting blocks configured to connect both sides of the front end of the tilting body and both sides of a front lower portion of the seat.

In addition, the pair of first connecting blocks may include hinge connecting ends formed to protrude upward and connected by hinge to the both sides of the middle lower portion of the seat, respectively.

The pair of first connecting blocks may be provided with rotation center protrusions, respectively, which are inserted into the inside of the tilting body, and a torsion bar may be provided within the tilting body. Both ends of the torsion bar are inserted into the torsion bar fastening recesses formed in the rotation center protrusions of the pair of first connecting blocks, respectively, so as to interconnect the pair of first connecting blocks.

In addition, a fixing block formed with a through-hole may be fixedly disposed within the tilting body, in which the torsion bar is inserted through the through-hole. The torsion bar fastening recesses, the through-hole, and the torsion bar may be formed to have a square cross-section.

In addition, when the pair of first connecting blocks are rotated in relation to the tilting body in cooperation with the back support, the torsion bar may convert the load of the back support into a torsional force.

The tilting type chair may further include a tilting adjusting lever disposed at a side of the seat to be rotatable forward and backward. The tilting body may include a body portion including an installation space formed therein, and a tilting limit locking section disposed in the installation space of the body portion. The tilting adjusting lever and the tilting limiting locking section is connected so that the tiling may be adjusted by the tilting limiting locking section when the tilting adjusting lever is rotated.

The tilting limit locking section may include: a guide block fixed in the installation space and including a forward-backward sliding hole formed to be opened in a forward and backward direction and a left-right sliding hole formed to be opened in a left and right direction; a locking sliding block configured to be slid along the forward-backward sliding hole; and a tilting locking block configured to be slid along the left-right sliding hole. The tilting locking block may be slid in cooperation with the locking sliding block.

The forward-backward sliding hole and the left-right sliding hole may be provided one on another to be partly overlapped, the locking sliding block may be formed with a guide pin protruding into the left-right sliding hole, and the tilting locking block may be formed with a guide slot into which the guide pin is inserted.

The forward-backward sliding hole may be provided at a position lower than the left-right sliding hole.

The guide slot may be formed to be inclined so that the tilting locking block is slid to a position where a tip end of the tilting locking block protrudes to the outside of the body portion.

A locking knob may be formed on the tip end of the tilting locking block to protrude in a longitudinal direction. Here, a locking recess into which the locking knob protruding to the outside of the body portion is inserted may be formed in the first connecting blocks.

The body portion may be formed with a locking hole through which the locking knob may be inserted to be exposed to the outside of the body portion.

A wire position changing protrusion may be formed in the seat to change a position of the wire.

According to the exemplary embodiment of the present invention, a tilting type chair is configured such that the seat of the chair may be moved up and down in response to the tilting operation of the back support of the chair. As a result, a more comfortable seating feeling may be provided to the user seated on the seat of the chair.

In addition, the tilting may be limited as needed by the user. Thus, the tilting type chair of the present invention may further improve the user's convenience.

BRIEF DESCRIPTION OF THE DRAWINGS

The above and other objects, features and advantages of the present invention will be more apparent from the following detailed description taken in conjunction with the accompanying drawings, in which.

DETAILED DESCRIPTION OF THE EXEMPLARY EMBODIMENTS

Hereinafter, an exemplary embodiment of a tilting type chair according to the present invention will be described in detail.

Figure 1:
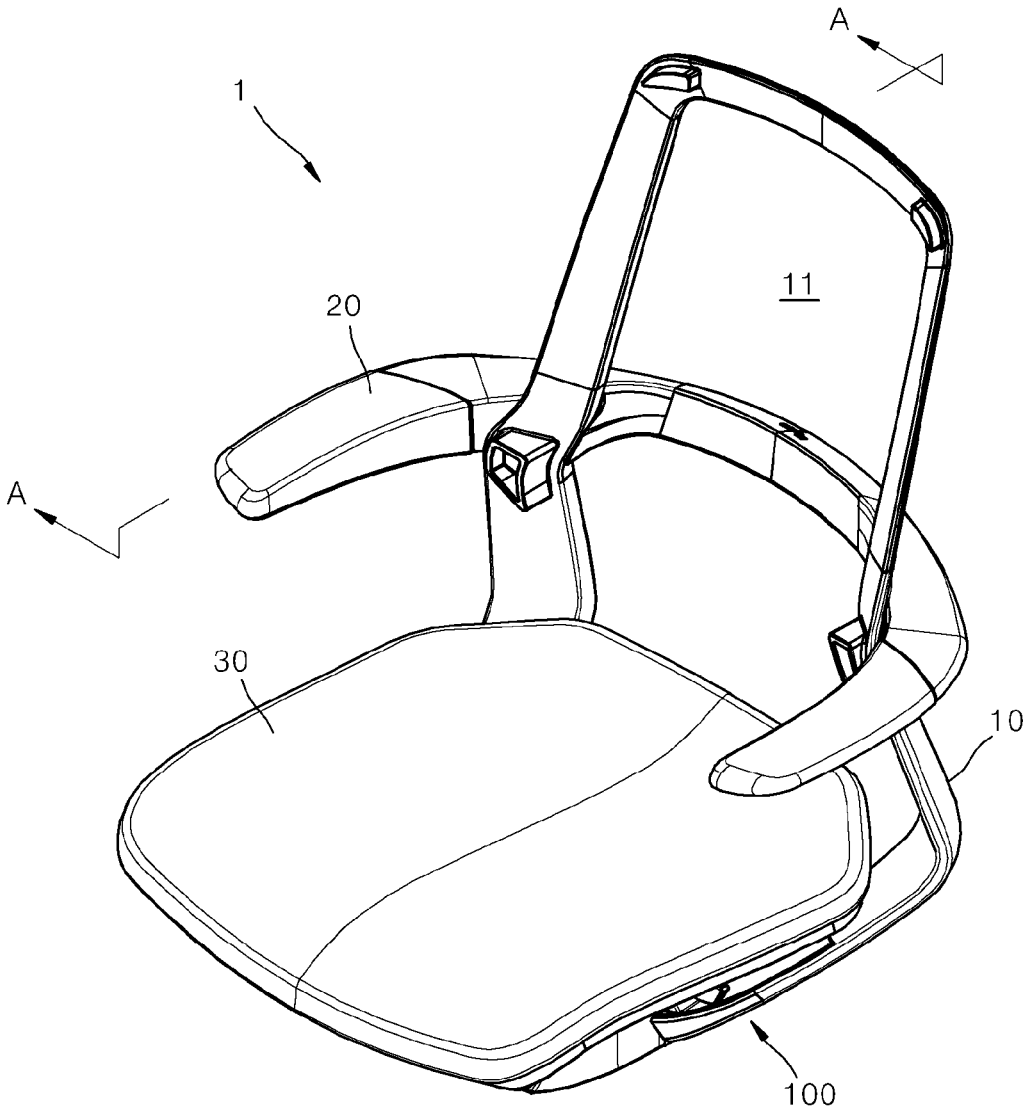
FIG. 1 is a perspective view illustrating an exemplary embodiment of a tilting type chair according to the present invention.
Figure 2:
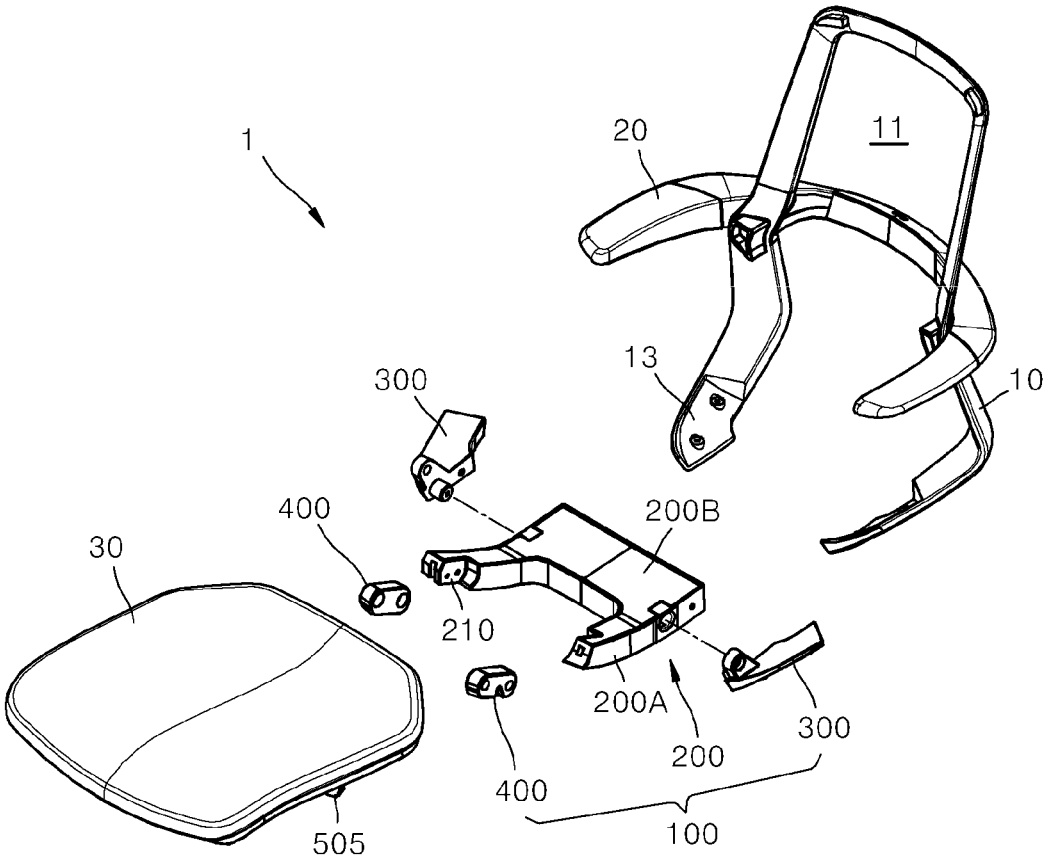
FIG. 2 is an exploded perspective view of FIG. 1.
Figure 3:
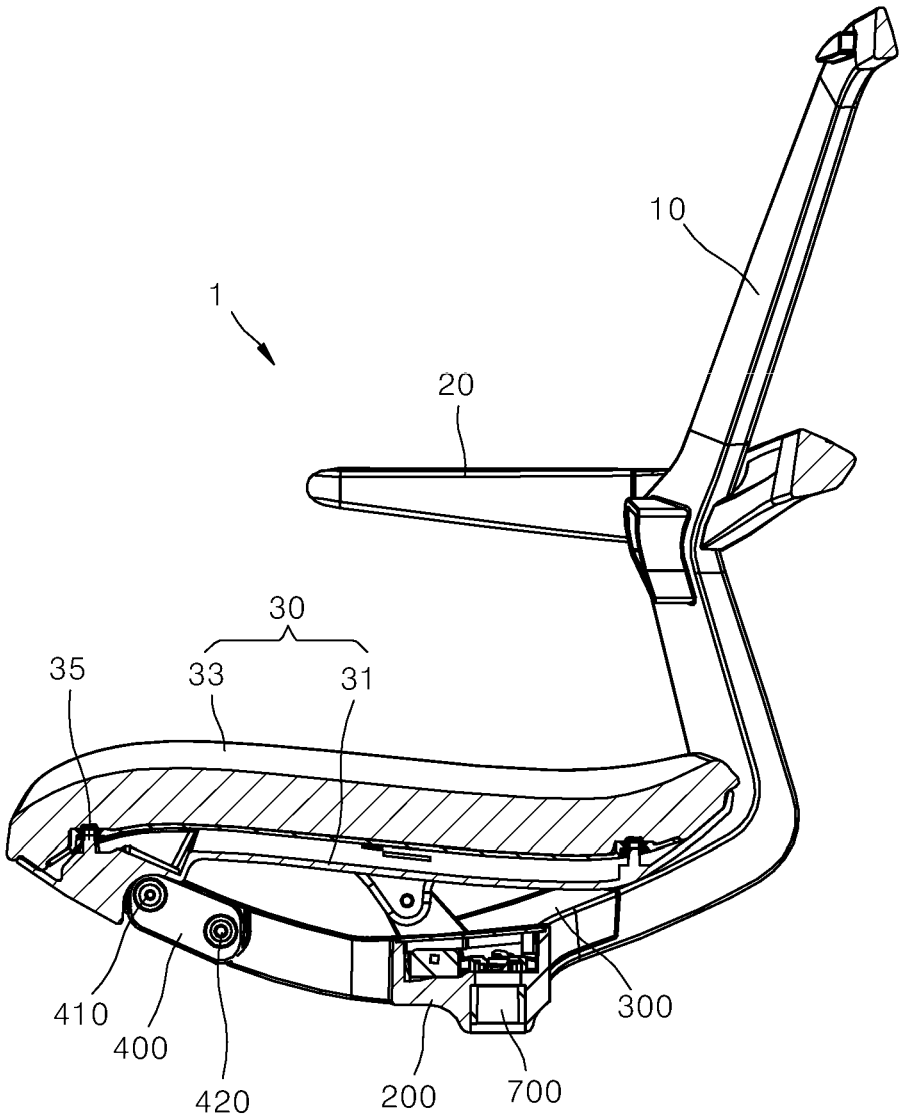
FIG. 3 is a cross-sectional view taken along line A-A of FIG. 1.
Figure 4:
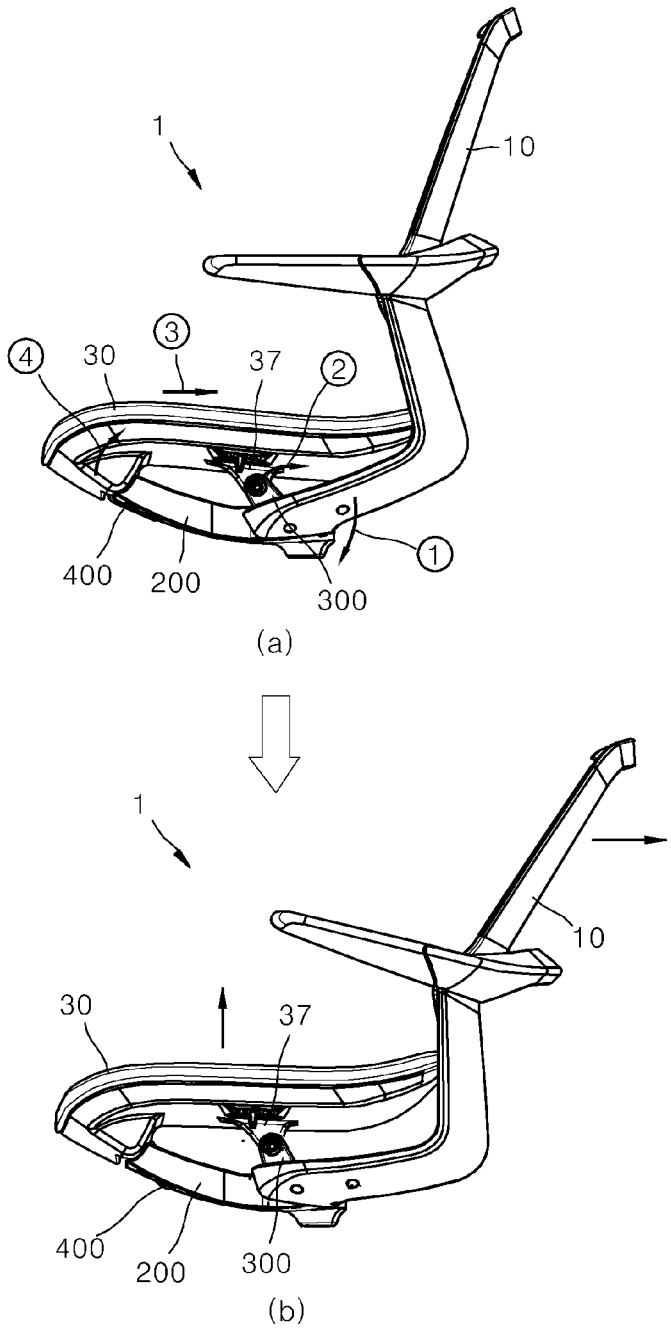
FIG. 4 is a side view illustrating a tilting state of the tilting type chair according to the present invention.

FIG. 1 is a perspective view illustrating a tilting type chair according to an exemplary embodiment of the present invention, FIG. 2 is an exploded perspective view of FIG. 1, FIG. 3 is a cross-sectional view taken along line A-A of FIG. 1, and FIG. 4 is a side view illustrating a tilting state of the tilting type chair according to the present invention.

As illustrated in FIGS. 1 to 4, a tilting type chair 1 according to an exemplary embodiment of the present invention includes a seat 30 on which a user is seated, a back support 10 that supports a back portion of the user who is seated on the seat 30, and a tilting section 100 interposed between the back support 10 and the seat 30 to interconnect the back support 10 and the seat 30.

The tilting section 100 is configured to perform the following action: when the user applies a load to the back support 10 so as to bend the back support 10 backward, the tilting section 100 moves the seat 30 upward in proportion to the applied load, and when the load applied to the back support 10 by the user is removed, the titling section 100 moves the seat 30 downward in proportion to the removed load. A more specific tilting state of the seat 30 will be described in more detail below.

The back support 10 that supports the user's back portion is disposed to extend vertically, an opening 11 opened in a forward and backward direction is formed in the back support. An arm support 20 is provided at a middle portion of the back support 10 in the vertical direction. A cushion made of a foam or mesh material or a non-cushion material is installed in the opening 11 opened in the forward and backward direction so as to comfortably support the user's back. The lower end portion of the back support 10 is formed to be curved substantially to the front side.

As illustrated in FIG. 3, the seat 30 includes a lower frame 31, and a cushion 33 assembled to the top of the lower frame 31. The lower frame 31 and the cushion 33 may be fastened to each other via fastening members 35.

As illustrated in FIGS. 1 and 2, the seat 30 may further include a tilting adjusting lever 505 so as to limit the tilting performed by the tilting section 100. The tilting adjusting lever 505 protrudes outward from a side portion of the lower frame 31 in which the tilting adjusting lever 505 may be configured such that one end portion protruding outward (hereinafter, referred to as "outward protruding end") may be rotated forward or backward by a predetermined angle around an internal hinge connection point (see FIG. 11 in which no reference numeral is assigned). The tilting adjusting lever 505 is connected, via a wire 800, with a locking sliding block 530, which is one of the components of a tilting limit locking section 500, which is one of the components of the tilting section 100 to be described later. Thus, the tilting adjusting lever 505 may be configured such that when the outwardly protruding end of the tilting adjusting lever 505 is rotated forward, the tilting of the seat 30 performed by the tilting section 100 is limited, and when the outwardly protruding end of the tilting adjusting lever 505 is rotated backward, the seat 30 may be tilted. This will be described in detail below.

As illustrated in FIGS. 2 and 3, the tilting section 100: includes a tilting body 200 disposed between the back support 10 and the seat 30; a pair of first connecting blocks 300 configured to connect both sides of a rear end of the tilting body 200 and both sides of a lower end of the back support 10 as well as to connect both sides of a middle lower portion of the seat 30 and both sides of the lower end of the back support 10, and to transfer a backward load (backward bending force) applied by the user and provided from the back support 10; and a pair of second connecting blocks 400 configured to connect both sides of the front end of the tilting body 200 and both sides of a front lower portion of the seat 30.

Coupling recesses 13 are formed at the both sides of the lower end of the back support 10, respectively, and a pair of first connecting blocks 300 are shape-matched and coupled to the coupling recesses 13, respectively. The pair of first connecting blocks 300 may be fastened to the coupling recesses 13 by fastening members (not illustrated) to be shape-matched to the coupling recesses 13, respectively.

The pair of first connecting blocks 300 are rigidly fixed to the both sides of the lower end of the back support 10 so that the backward load provided by the user through the back support 10 may be efficiently transferred to the tilting section 100 and the seat 30 connected thereto.

Figure 5:
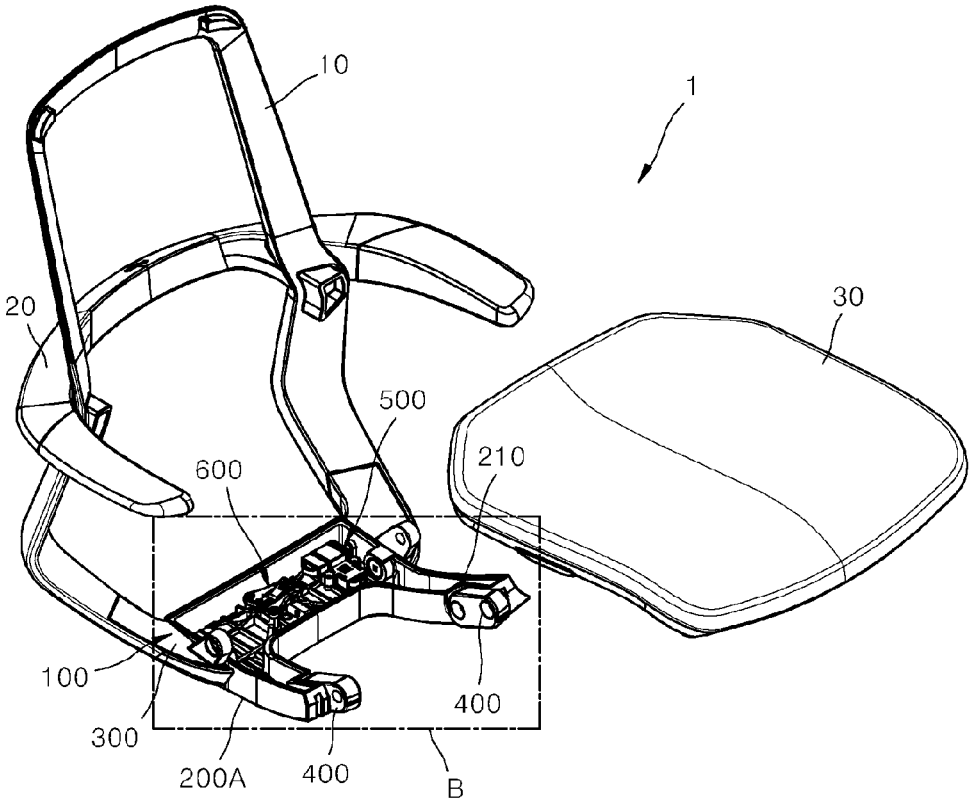
FIG. 5 is an exploded perspective view illustrating a state in which a tilting section among components in FIG. 1 is installed on a back support.
Figure 6:
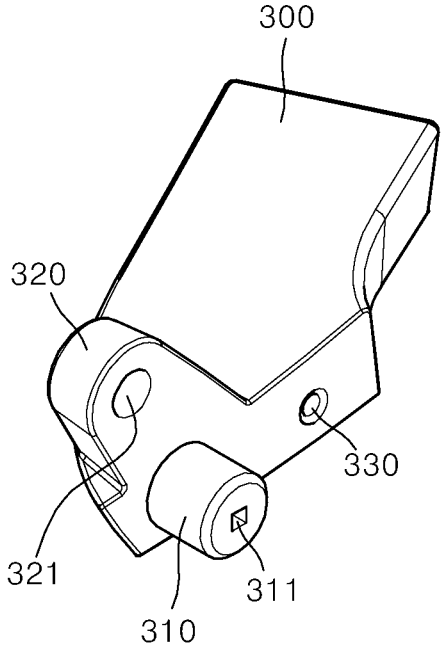
FIG. 6 is a perspective view illustrating a pair of first connecting blocks among components of the tilting section.

FIG. 5 is an exploded perspective view illustrating a state where the tilting section is installed on the back support among of the components illustrated in FIG. 1, and FIG. 6 is a perspective view illustrating one of a pair of first connecting blocks among the components of the tilting section.

As illustrated in FIGS. 5 and 6, the pair of first connecting blocks 300 may include hinge connecting ends 320, respectively, which protrude upward and are connected by hinge with the both sides of the middle lower portion of the seat 30. Each of the hinge connecting end 320 may be formed with a hinge fastener 321.

In addition, the pair of first connecting block 300 are formed with rotation center protrusions 310 which penetrate side portions of the tilting body 200 such that tip ends thereof are exposed to the inside of the tilting body 200, respectively, and a torsion bar fastening recess 311 having a rectangular shape may be formed on the tip end of each of the rotation center protrusions 310. One end of a torsion bar 110 to be described later may be inserted into and fastened to the torsion bar fastening recess 311.

Further, each of the pair of first connecting blocks 300 may have a locking recess 330 formed on a side portion which is plane-contacted with a side surface portion of the tilting body 200. A locking knob 540 is inserted into the locking recess 330. The locking knob 540 will be described later.

The pair of first connecting blocks 300 are connected with the middle lower portion of the seat 30 to be relatively rotated through the hinge fasteners 321 provided in the hinge connecting ends 320, and connected with the tilting body 200 when the torsion bars 110 are fastened to the torsion bar fastening recess 311 formed in the rotation center protrusions 310.

Meanwhile, as illustrated in FIGS. 2 and 3, each of the pair of second connecting blocks 400 is connected by hinge to a front end of the tilting body 200 at the rear end thereof and connected by hinge to the front lower portion of the seat 30 at the front end thereof. Hinge insertion holes 410 and 420 may be formed in the pair of second connecting blocks 400 and hinges (not illustrated) may be inserted into and fastened to the hinge insertion holes 410 and 420 for hinged connection of each of the second connecting blocks 400. In addition, connection recess portions 210 cut to have an L-shaped cross-section are formed on the front end portions of the tilting body 200, respectively, so that the connection recess portions 210 are shape-matched and coupled with the pair of second connecting blocks 400, respectively.

As illustrated in FIG. 4, the tilting section 100 configured as described above is operated as follows: when the user bends his/her back backward (①), a load is applied to the pair of first connecting blocks 300 connected to the lower end of the back support 10, the pair of first connecting blocks 300 receives a rotation force for rotating the hinge connecting ends 320 are rotated about the rotation center protrusions 310 extending to the inside of the tilting body 200 (②), the rotation force is converted into a moving force for moving the rear end of the seat backward (③), and the front end of the seat 30 is moved backward by the backward moving force of the seat 30 to move the seat 30 upward entirely (④).

The conventional tilting type chair exhibits a poor seating feeling on the seat when the chair is tilted, which causes a user to feel inconvenience. However, according to the tilting type chair of the present exemplary embodiment, the user seated on the seat 30 feels comfortable and the seating feeling on the seat 30 is also improved due to the tilting of the back support 10.

On the contrary, when the user bends his/her back forward, the load applied to the back support 10 is removed and thus, the tilting section 100 is operated in the following manner: the upper ends of the hinge connecting ends 320 of the pair of the first connecting blocks 300 connected to the lower end of the back support 10 are rotated around the rotation center protrusions 310 to the original positions thereof and the rear end of the seat 30 is moved forward, so that the seat 30 is entirely moved down to its original position.

As described above, the tilting operation of the back support 10 is performed when a load is applied to or removed from the back support 10, and the seat 30 is moved up or down in response to the tilting operation of the back support 10, a more comfortable seating feeling may be provided to the user seated on the seat 30.

Figure 7:
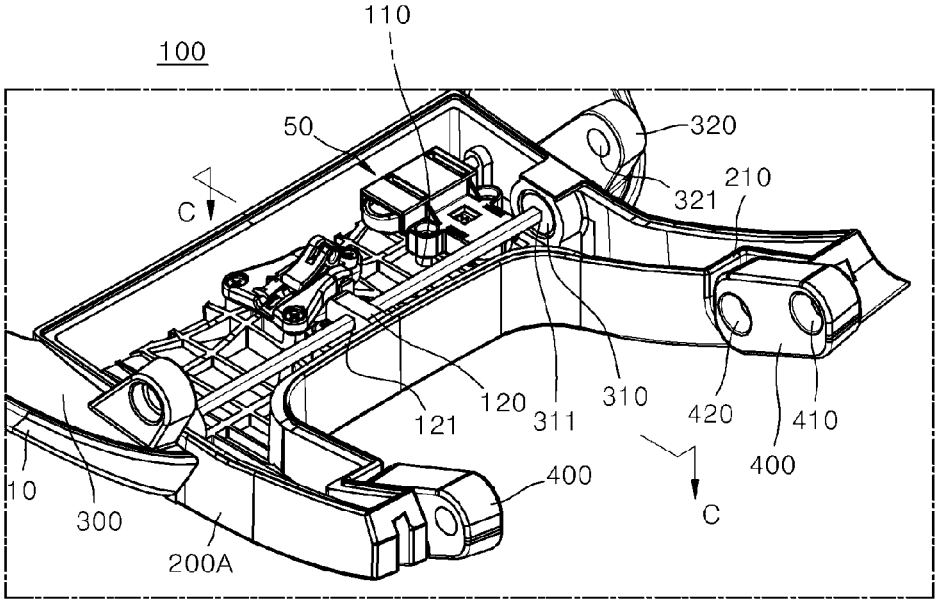
FIG. 7 is an enlarged view illustrating a "B" portion in FIG. 5 in an enlarged scale.
Figure 8:
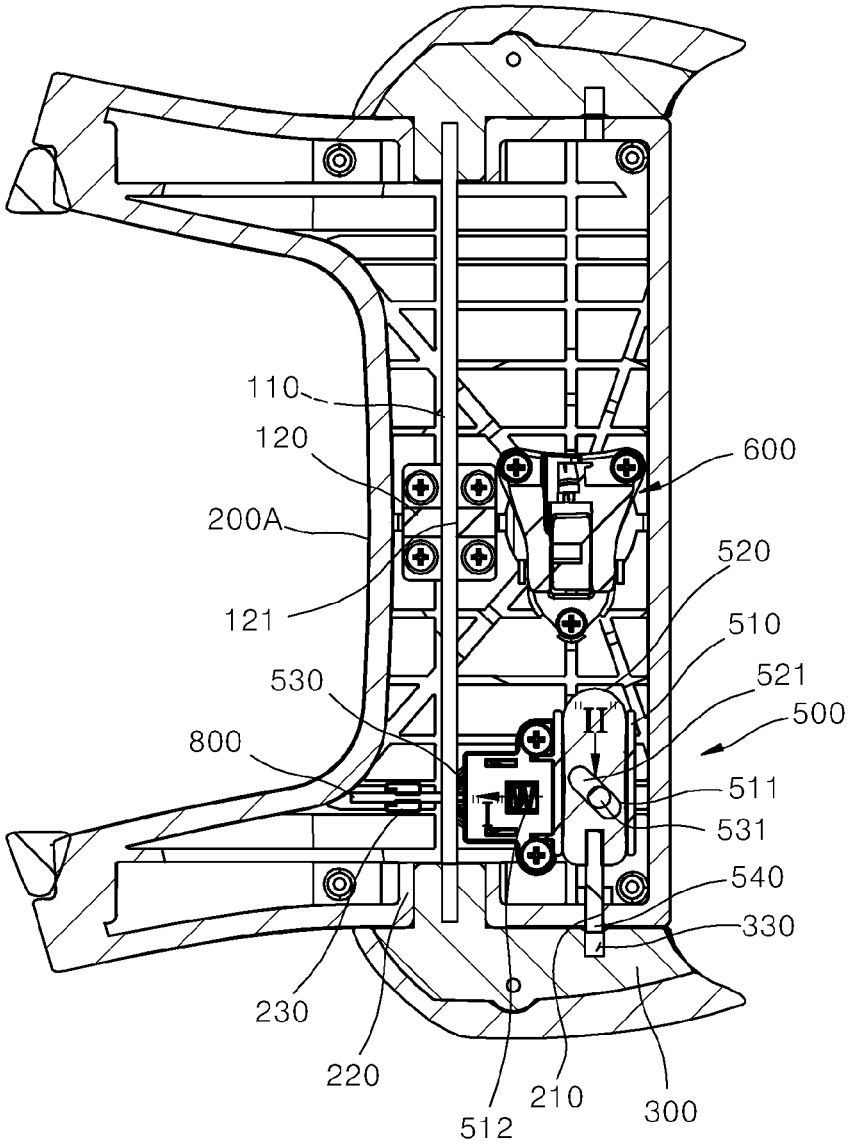
FIG. 8 is a cross-sectional view taken along line C-C in FIG. 7.
Figure 9:
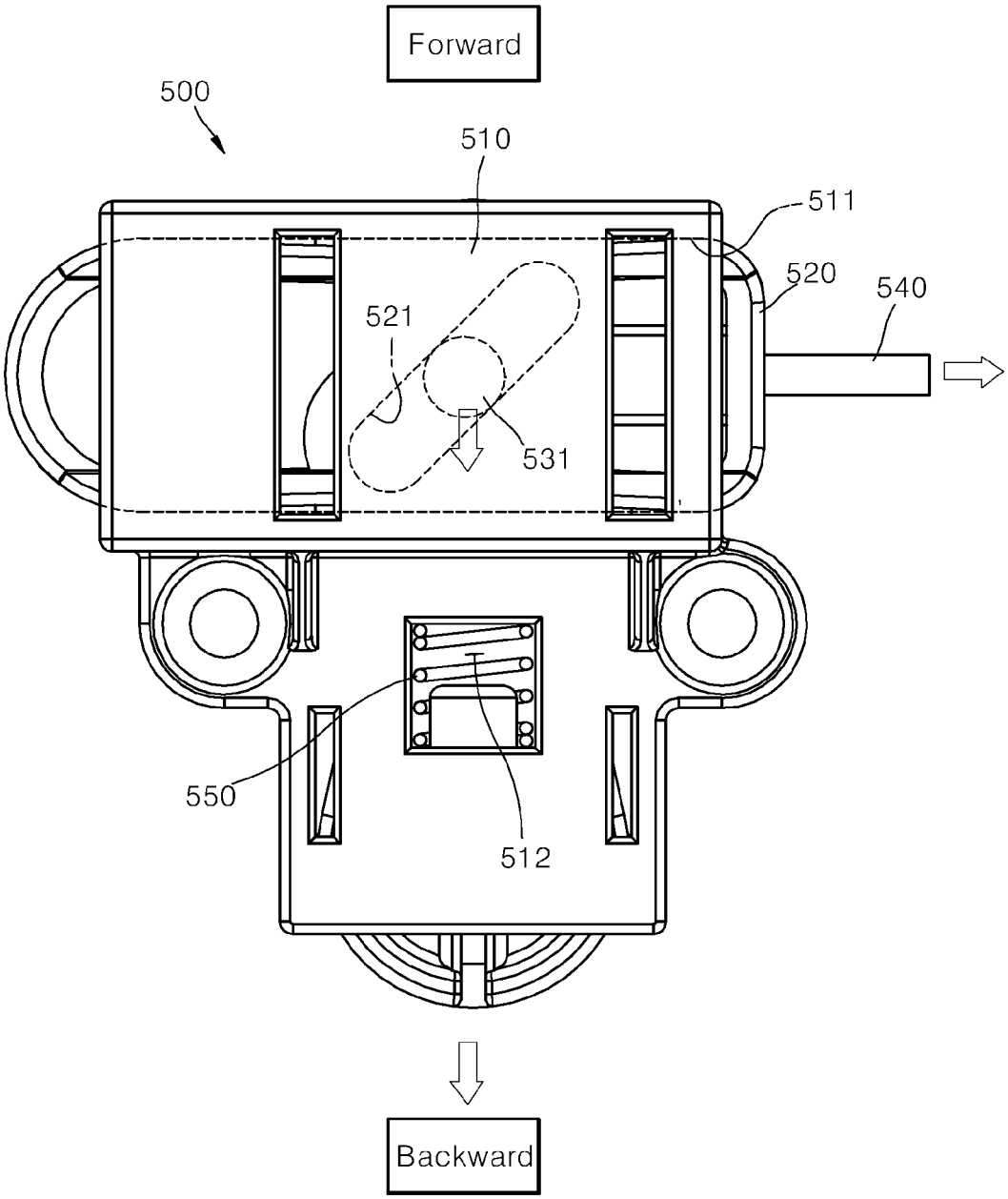
FIG. 9 is a plan view illustrating an operation of a tilting limit locking section by the tilting adjusting lever, among the components of the tilting section.
Figure 10:
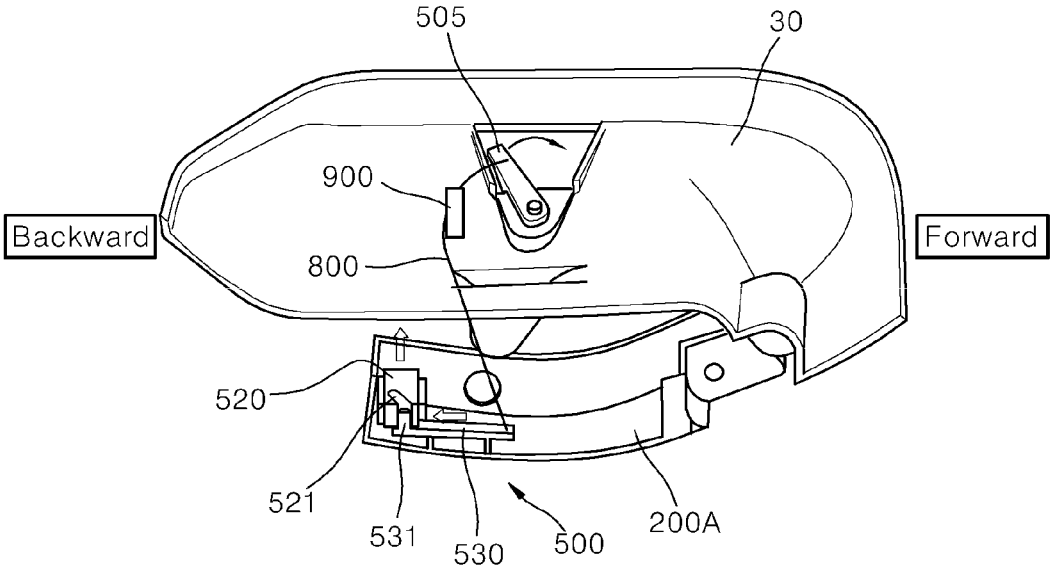
FIG. 10 is a perspective view illustrating the operation of the tilting limit locking section of FIG. 9.
Figure 11:
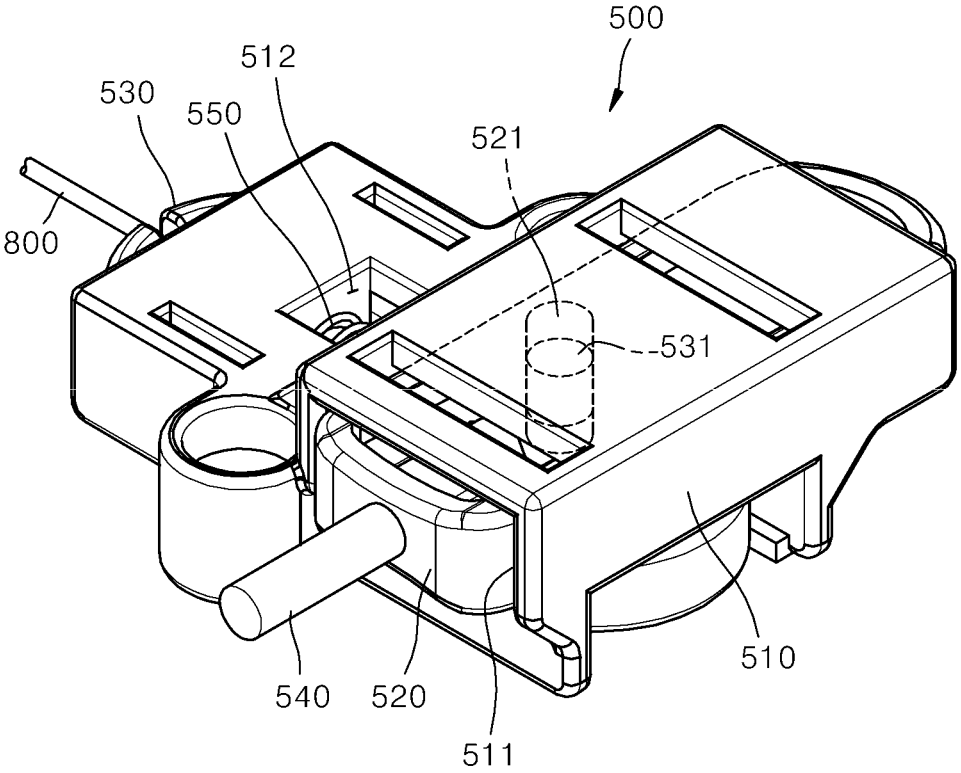
FIG. 11 is a perspective view illustrating a configuration of the tilting limit locking section illustrated in FIGS. 9 and 10.

FIG. 7 is an enlarged perspective view illustrating the "B" portion in FIG. 5 in an enlarged scale, and FIG. 8 is a cross-sectional view taken along line C-C in FIG. 7. In addition, FIG. 9 is a plan view illustrating an operation of a tilting limit locking section by the tilting adjusting lever, among the components of the tilting section, FIG. 10 is a perspective view illustrating the operation of the tilting limit locking section of FIG. 9, and FIG. 11 is a perspective view illustrating a configuration the tilting limit locking section illustrated in FIGS. 9 and 10.

As illustrated in FIGS. 7 to 11, the tilting body 200 may include a body portion 200A formed with an installation space therein, and a body cover 200B coupled to cover the top side of the body portion 200A.

In the installation space in the body portion 200A, a torsion bar 110 may be disposed in the left and right direction to interconnect torsion bar fastening recesses 311 formed in the rotation center protrusions 310 of the pair of first connecting blocks 300 described above, and the above-described tilting limit locking section 500, and a height adjusting section 600 operated by a height adjusting lever (not illustrated) may also be disposed in the installation space in the body portion 200A.

As illustrated in FIG. 8, one end of the torsion bar 110 is inserted into and fixed to a torsion bar fastening recess 311 formed in a rotation center protrusion 310 of one of the pair of the first connecting blocks 300 and the other end of the torsion bar 110 is inserted into and fixed to a torsion bar fastening recess 311 formed in a rotation center protrusion 310 of the other of the pair of the first connecting blocks 300. Each of the torsion bar fastening recesses 311 may be formed to have a square cross-section so as to prevent the relative rotation of the torsion bar 110 therein, and the torsion bar 110 may also be formed to have a square cross-section. However, the torsion bar 110 and the torsion bar fastening recess 311 may have the same cross-sections other than the square cross-section.

Meanwhile, a fixing block 120 is provided in the installation space in the body portion 200A at a portion corresponding to the middle portion of the torsion bar 110 disposed in the left and right direction, and is fixed to the body portion 200A so as to fix the body portion 200A such that the body portion 200A cannot be rotated in relation to the torsion bar 110. The fixing block 120 is rigidly fixed to the body portion 200A by fastening members (which are not assigned with reference numerals), and a through-hole 121 is formed in the fixing block 120. The torsion bar 110 is installed through the through-hole 121. Like the torsion bar fastening recesses 311, the through-hole 121 may be formed to have a square cross-section which is the same as that of the torsion bar 110.

In addition to interconnecting the pair of first connecting blocks 300, the torsion bar 110 also serves to transfer user's load provided thereto from the back support 10 to the seat 30. That is, because the middle portion of the torsion bar 110 penetrates through the through-hole 121 of the fixing block 120 fixed to the installation space of the body portion 200A, the torsion bar 110 converted the user's load (bending-back force) provided through the back support 10 into a torsional force so that the lower end of the back support 10 is rotated in relation to the tilting body 200 and at that time, the upper end of the hinge connecting end 320 is rotated backward, thereby moving the seat 30 upward.

As described above, because the torsional force by the torsion bar 110 may rotate the lower end of the back support 10 in relation to the tilting body 200, the seat 30 may be tilted. According to an exemplary embodiment of the present invention, the tilting type chair 1 may be provided with a tilting limit locking section 500 in the installation space of the body portion 200A so that the tilting is not performed as needed by the user.

As illustrated in FIGS. 7 to 9, the tilting limit locking section 500 may include: a guide block 510 fixed in the installation space of the body portion 200A and provided with a forward-backward sliding hole 512 formed to be opened in a forward and backward direction and a left-right sliding hole 511 formed to be opened in a left and right direction; a locking sliding block 530 arranged to be slidable back and forth within the forward-backward sliding hole 512 by an external force; and a tilting locking block 520 arranged to be slidable within the left-right sliding hole 511 and sliding in the left and right direction in cooperation with the sliding movement of the locking sliding block 530.

As illustrated in FIG. 10, the front end of the locking sliding block 530 is connected with the tilting adjusting lever 505 via the wire 800, and when the tilting adjusting lever 505 is rotated forward, the locking sliding block 530 is slid forward. An elastic member installation groove (which is assigned with no reference numeral) is formed on the locking sliding block 530, and the elastic member 550 is installed in the elastic member installation groove such that one end of the elastic member 550 is fixed to the guide block 510 and the other end of the elastic member 550 is supported on the locking sliding block 530 which is slid. Here, the elastic member 550 may be a coil spring.

When the locking sliding block 530 is slid forward, the elastic member 550 is compressed, and then, when the pulling force of the wire 800 of the tilting adjusting lever 505 is released, the elastic member 550 is returned to its original position so as to cause the locking sliding block 530 to be slid backward.

The tilting adjusting lever 505 is positioned above the front portion of the tilting limit locking section 500, in which, when the tilting adjusting lever 505 and the tilting limit locking section 500 are arranged to have a rapid inclination, the operation of the tilting limit locking section 500, which is induced by the rotation of the tilting adjusting lever 505, may not be smooth. According to an exemplary embodiment of the present invention, as illustrated in FIG. 10, the tilting type chair 1 may be provided with a wire position changing protrusion 900 at a portion of the seat 30 corresponding to a side of the tilting adjusting lever 505 and the wire 800 may be disposed to surround the wire position changing protrusion 900 so as to continuously maintain the tension of the wire 800 interconnecting the tilting adjusting lever 505 and the tilting limit locking section 500 and the problem of non-smooth operation.

Meanwhile, the rear portion of the forward-backward sliding hole 512 in which the locking sliding block 530 is inserted may be formed to be partially overlapped with the left-right sliding hole 511 in which the tilting locking block 520 is inserted with the forward-backward sliding hole 512 being provided at a position lower than the left-right sliding hole 511. Here, at an upper side of the rear end of the locking sliding block 530, a guide pin 531 protruding into the left-right sliding hole 511 may be integrally formed, and the tilting locking block 520 may be formed with a guide slot 521 into which the guide pin 531 is inserted upwardly from a position below the guide slot 521.

Assuming that tilting limit locking section 500 is provided at a rear left side in the installation space of the body portion 200A, the guide slot 521 may be formed to be inclined to the left toward the rear side, as illustrated in FIG. 10. When the guide slot 521 is formed to be inclined to the left toward the rear side, while the locking sliding block 530 is slid forward, the guide pin 531 is moved forward, which causes the tilting locking block 520 to be moved to the left.

Meanwhile, a locking knob 540 may be formed on a left tip end of the tilting locking block 520 to protrude in a longitudinal direction, and a locking hole 210 communicated with the outside may be formed in the body portion 200A adjacent to the locking knob 540. When the tilting locking block 520 is slid leftward, the locking knob 540 is inserted, through the locking hole 210, into a locking recess 330 formed in one of the pair of the first connection blocks 300 which is positioned adjacent to the locking knob 540, thereby performing a locking function that prevents further tilting. That is, when the tip end of the locking knob 540 is inserted into the locking recess 330, the relative rotation of the tilting body 200 and the pair of the first connecting blocks 300 is restricted so that further tilting cannot be performed.

According to the exemplary embodiment of the present invention, a height adjusting section 600 configured to adjust the height of the tilting type chair 1 may be provided at a rear central portion in the installation space of the body portion 200A. A configuration already known in the art may be employed in the height adjusting section 600 as it is. However, a main feature is that constituent parts are installed in the tilting body 200 for the purpose of intensive installation of the constituent parts. Since the specific operating relationship of the height adjusting section 600 is not closely related to the contents of the tilting type chair 1 according to the present invention, descriptions thereof will be omitted.

Meanwhile, a rotating tube 700 may be provided at a rear lower side of the body portion 200A, and a rotation shaft of legs (not illustrated) provided to be rotated in relation to the body portion 200A may be inserted into the rotating tube 700 (see FIG. 3).

Next, the operation state of the tilting type chair 1 configured as described above according to an exemplary embodiment of the present invention will be described briefly with reference to the accompanying drawings (in particular, FIG. 4).

First, when the user is seated on the seat 30 and leans his/her back against the back support 10 to bend the back support 10 backward, the lower end of the back support 10 is rotated downward by a predetermined angle using the rotation center protrusion 310 as a rotation center (①), and the hinge connecting ends 320 of the pair of first connecting blocks 300 are rotated upward by a predetermined angle using the rotation center protrusion 310 as a rotation center (②).

When the hinge connecting ends 320 of the pair of first connecting blocks 300 are rotated, the seat 30 is moved backward (③). At this time, the pair of second connecting blocks 400 are rotated so that the seat 30 is moved upward by a predetermined height (④).

In particular, the downward rotation of the lower end of the back support 10 by the predetermined angle (①) and the upward rotation of the hinge connecting ends 320 of the pair of the first connecting blocks 300 (②) are performed since the load applied to the back support 10 is converted into a torsional force by the torsion bar 110 provided through the through-hole 121 of the fixing block 120 rigidly fixed in the installation space of the body portion 200A.

In addition, the tilting may be limited as needed by the user in the following manner. When the tilting adjusting lever 505 protruding to a side of the seat 30 in a state where the tilting is not executed is rotated forward, the locking knob 540 of the tilting limit locking section 500 provided within the tilting body 200 is inserted into the locking recess 330 of the first connecting block 300. As a result, the tilting can be limited.

Next, when the user separates his/her back forward from the back support 10, the back support 10 is returned forward depending on the reduced extent of the load applied to the back support 10 by the user. This is because the torsional force generated by the torsion bar 110 acts as a restoration force of the back support 10.

According to the present invention configured as described above, tilting is executed depending on a direction of a load or movement applied to the back support of the chair by the user and the vertical height of the seat 30 is adjusted in response the tilting, which improves the user's comfortability.

In the foregoing, a tilting type chair according to exemplary embodiments of the present invention has been described with reference to the accompanying drawings. However, it is evident that the present invention is not necessarily limited to the above-described exemplary embodiments and various modifications and equivalents may be made by a person ordinarily skilled within the scope of the present invention. Thus, the true scope of the present invention to be protected should be determined based on the accompanying claims.

What is claimed is:

1. A tilting type chair comprising:

a seat configured for a user to be seated thereupon;

a back support configured to support a back portion of the user seated on the seat; and a tilting section interposed between the back support and the seat to couple the seat to the back support, wherein, when the user applies a load to bend the back support backward, the tilting section moves the seat upward in proportion to the load applied by the user, and, when the load applied to the back support by the user is removed, the tilting section moves the seat downward in proportion to the removed load, wherein the tilting section includes:

a tilting body disposed between the back support and the seat;

a pair of first connecting blocks configured to connect both sides of a rear end of the tilting body and both sides of a lower end of the back support as well as to connect both sides of a middle lower portion of the seat and both sides of the lower end of the back support; and a pair of second connecting blocks configured to connect both sides of the front end of the tilting body and both sides of a front lower portion of the seat.

2. The tilting type chair of claim 1, wherein the pair of first connecting blocks include hinge connecting ends formed to protrude upward and connected by hinge to the both sides of the middle lower portion of the seat.

3. The tilting type chair of claim 1, wherein the pair of first connecting blocks are provided with rotation center protrusions, respectively, which are inserted into the inside of the tilting body, and a torsion bar is provided within the tilting body, both ends of the torsion bar being inserted into the torsion bar fastening recesses formed in the rotation center protrusions of the pair of first connecting blocks, respectively, so as to interconnect the pair of first connecting blocks.

4. The tilting type chair of claim 3, wherein a fixing block formed with a through-hole is fixedly disposed within the tilting body, the torsion bar being inserted through the through-hole, and the torsion bar fastening recesses, the through-hole, and the torsion bar are formed to have a square cross-section.

5. The tilting type chair of claim 4, wherein, when the pair of first connecting blocks are rotated in relation to the tilting body in cooperation with the back support, the torsion bar converts the load of the back support into a torsional force.

6. The tilting type chair of claim 3, further comprising:

a tilting adjusting lever disposed at a side of the seat to be rotatable forward and backward, wherein the tilting body includes a body portion including an installation space formed therein, and a tilting limit locking section disposed in the installation space of the body portion, the tilting limit locking section includes a guide block fixed in the installation space and including a forward-backward sliding hole formed to be opened in a forward and backward direction and a left-right sliding hole formed to be opened in a left and right direction, and a locking sliding block configured to be slid along the forward-backward sliding hole, and a front end of the locking sliding block is connected with the tilting adjusting lever via a wire, and when the tilting adjusting lever is rotated forward, the locking sliding block is slid forward.

7. The tilting type chair of claim 6, wherein the tilting limit locking section further includes a tilting locking block configured to be slid along the left-right sliding hole, the forward-backward sliding hole and the left-right sliding hole are provided one on another to be partly overlapped with each other, a guide pin protruding into the left-right sliding hole is formed on the locking sliding block, and a guide slot is formed in the tilting locking block, the guide pin being inserted into the guide slot, and when the locking sliding block is slid forward, the guide pin is moved forward to cause the tilting locking block to be slid.

8. The tilting type chair of claim 7, wherein the forward-backward sliding hole is provided at a position lower than the left-right sliding hole.

9. The tilting type chair of claim 7, wherein the guide slot is formed to be inclined so that the tilting locking block is slid to a position where a tip end of the tilting locking block protrudes to the outside of the body portion.

10. The tilting type chair of claim 9, wherein a locking knob is formed on the tip end of the tilting locking block to protrude in a longitudinal direction.

11. The sliding type chair of claim 10, wherein the first connecting block is formed with a locking recess into which the locking knob protruding to the outside of the body portion is inserted.

12. The tilting type chair of claim 10, wherein the body portion is formed with a locking hole through which the locking knob is inserted to be exposed to the outside of the body portion.

13. The tilting type chair of claim 6, wherein a wire position changing protrusion is formed in the seat to change a position of the wire.

* * * * *